166-307 SR

3/3/81 XR 4,253,522

United States Patent [19]

Setterberg, Jr.

[11] 4,253,522

[45] Mar. 3, 1981

[54] GRAVEL PACK TOOL

[75] Inventor: John R. Setterberg, Jr., Richardson, Tex.

[73] Assignee: Otis Engineering Corporation, Dallas, Tex.

[21] Appl. No.: 41,001

[22] Filed: May 21, 1979

[51] Int. Cl.[3] ..... E21B 43/04

[52] U.S. Cl. ..... 166/278; 166/51; 166/305 R; 166/307

[58] Field of Search ..... 166/278, 312, 51, 100, 166/147, 185, 205, 334

[56] References Cited

U.S. PATENT DOCUMENTS

| | | | |
|---|---|---|---|
| 3,051,243 | 8/1962 | Grimmer et al. | 166/332 |
| 3,398,795 | 8/1968 | Elliston | 166/120 |
| 3,710,862 | 1/1973 | Young | 166/278 |
| 3,726,343 | 4/1973 | Davis, Jr. | 166/278 |
| 3,913,675 | 10/1975 | Smyrl | 166/278 |
| 4,105,069 | 8/1978 | Baker | 166/51 |
| 4,180,132 | 12/1979 | Young | 166/129 |

*Primary Examiner*—James A. Leppink

*Attorney, Agent, or Firm*—Thomas R. Felger

[57] ABSTRACT

A well tool for depositing a gravel pack into an annulus formed between a casing string and the lower portion of a production tubing string. The well tool includes a sliding sleeve valve which can be shifted to allow communication of a gravel pack slurry to the annulus through lateral ports in the sleeve valve. The sleeve valve includes shoulders which extend to engage a shifting tool preventing removal of the shifting tool from the sleeve valve with the lateral ports open. The sleeve valve allows improved methods to be used to compress the gravel pack and remove undesired fluids from the gravel pack. Methods are disclosed to position the sleeve valve to allow the gravel pack slurry to flow into the annulus or to isolate the annulus and compress the gravel pack. The preferred well installation for using this invention includes a production packer with the sleeve valve and a gravel pack screen attached to the lower end of the packer. The packer is positioned at a preselected location within the casing string and a production tubing string can be engaged with the upper end of the packer after the gravel pack has been deposited and the sleeve valve has been closed.

13 Claims, 5 Drawing Figures

GRAVEL PACK TOOL

BACKGROUND OF THE INVENTION

1. Field of the Invention

The present invention comprises a sleeve valve means and methods for forming a gravel or slurry pack within a well bore.

2. Description of the Prior Art

The use of gravel of slurry packs in oil and gas wells is a well known means for controlling sand contained within formation fluids. A good gravel pack can significantly increase production tubing life and minimize expensive workovers to remove sand bridges or plugs formed within production tubing by sand settling out of formation fluids.

Many tools have been developed to allow a gravel pack to be formed within a well bore adjacent a hydrocarbon producing formation to filter sand and other particulate matter out of the formation fluids. U.S. Pat. No. 4,105,069 to Eugene E. Baker discloses an improved liner assembly and selective opening sleeve positioner for use in forming a gravel pack.

U.S. Pat. No. 3,710,862 to Carter R. Young discloses apparatus for and methods of installing a well packer and screen, treating the well, gravel packing around the screen, removing the service seal unit, and installing a production tubing string.

U.S. Pat. No. 4,180,132 invented by Carter R. Young discloses various improved tools and methods for placing a gravel pack within a well bore.

U.S. Pat. No. 3,051,243 to G. G. Grimmer et al discloses a sleeve valve for controlling fluid flow through a lateral port. The sleeve valve in U.S. Pat. No. 3,051,243 is operated by wireline tools.

The present invention significantly reduces the complexity of prior art gravel pack tools and the number of required trips of tool strings into the well bore to install a gravel pack.

SUMMARY OF THE INVENTION

The present invention discloses a well tool for controlling fluid communication from the interior of the tool to the exterior of the tool, comprising a housing having a longitudinal bore extending therethrough, means for connecting each end of said housing to other well tools, a sleeve slidably disposed within said longitudinal bore and having a longitudinal passageway extending therethrough, a lateral port communicating fluid between said longitudinal bore and the exterior of said housing, a lateral passageway extending through the wall of said sleeve, means for sealing between the outside diameter of said sleeve and the inside diameter of said housing, said sealing means spaced longitudinally on either side of said lateral passageway, said sleeve having three positions with respect to said housing, the first position allowing fluid communication from the longitudinal passageway of said sleeve through said lateral passageway and said lateral port to the exterior of said housing, said sleeve slidable longitudinally in one direction with respect to said housing to its second position blocking communication through said lateral port and said sleeve slidable longitudinally in the other direction with respect to said housing to its thrid position blocking communication through said lateral port, and means for releasably holding said sleeve in each position.

One object of the present invention is to provide a tool for dispositing a gravel pack within a well bore.

Another object of the present invention is to disclose methods for depositing a gravel pack within a well bore to compress the gravel pack and remove undesired fluids from the gravel pack.

Still another object of the present invention is to provide a well tool with a sliding sleeve valve having three positions, the first position allowing communication of fluid with the exterior of the well tool and the second and third positions blocking fluid communication. The sleeve valve can engage a shifting tool such that the shifting tool can be removed from the sleeve valve only when the sleeve valve is in its second or third position.

These and other objects and advantages of the present invention will become apparent from the following drawings, detailed description and claims.

DESCRIPTION OF THE PREFERRED EMBODIMENT

Figure 1A:
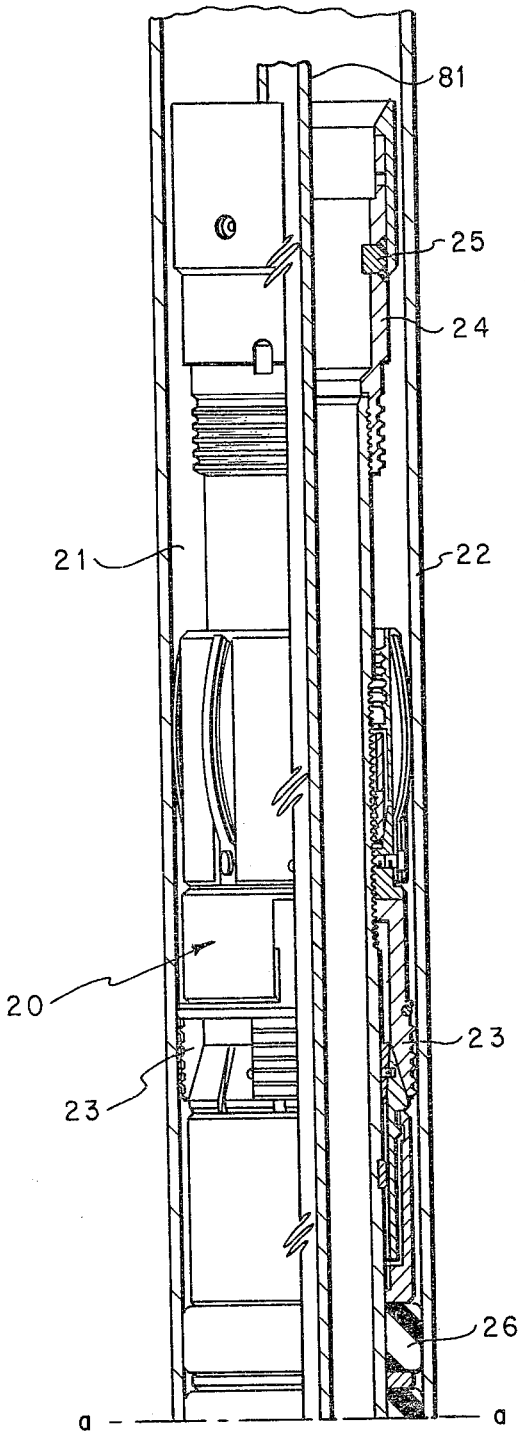
FIGS. 1A, 1B, 1C and 1D are drawings, partially in section and elevation, showing a typical well installation using the present invention below a production packer. The sleeve valve is in its first position allowing communication of a gravel pack slurry down the service tubing string, through the shifting tool and sleeve valve, and into the annulus between the casing and production string below the packer.

Referring to the drawings and particularly FIGS. 1A–1D, well packer 20 is shown secured within the bore 21 of casing 22 by slips 23 carried on packer 20. Receiving head 24 on the upper end of packer 20 contains a lug 25 which can be engaged with a production tubing string (not shown). When the well installation has been completed, packing elements 26 form a fluid tight seal with the inside diameter of casing 22 to direct formation fluids, flowing into casing 22 through perforations 31 such shown in FIG. 5 below packer 20, through a production tubing string (not shown) from head 24 to the well surface. A packer satisfactory for use with the present invention is disclosed in U.S. Pat. No. 3,398,795 to T. L. Elliston. U.S. Pat. No. 3,398,795 is incorporated by reference for all purposes.

Frequently, formation fluids contain fine grained particulate material referred to generally as sand. At location of low fluid flow, the sand will be deposited within the production tubing string contained within the well bore. Under the worst conditions, sand can completely plug or bridge the production tubing string. The cost of removing a sand bridge is very expensive.

One method of controlling sand is to install a gravel pack within the annulus 27 formed between casing 22 and the well tolls plus production tubing extending below packer 20. U.S. Pat. No. 3,710,862 to Carter R. Young and U.S. Pat. No. 4,105,069 to Eugene E. Baker disclose various methods and tools for installing a gravel pack within a well bore. Both patents are incorporated by reference for all purposes.

Figure 5:
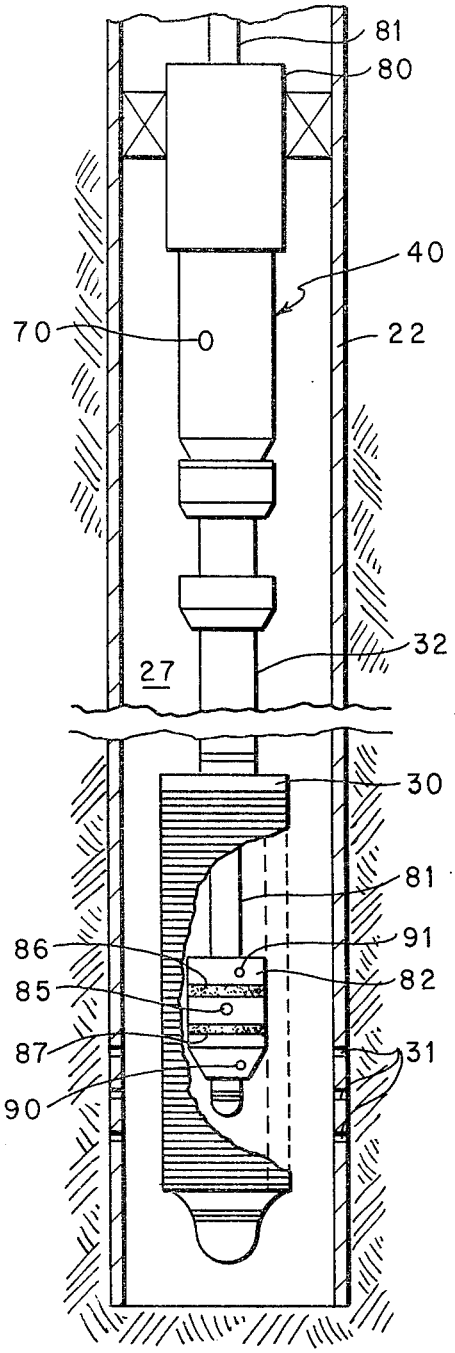
FIG. 5 is a schematic drawing, partially in section and elevation, showing the present invention with the sleeve valve in its second position and the shifting tool lowered to compress the gravel pack.

Under preferred conditions, the casing string is perforated adjacent a hydrocarbon producing formation. A gravel pack screen 30 as shown in FIG. 5 is positioned opposite perforations 31. A fluid slurry comprising water, gel, and gravel is then pumped from the well surface to annulus 27 surrounding screen 30. The size of the perforations, gravel, and screen openings are preselected such that the gravel filters out and removes sand from the formation fluids before the formation fluids enter the production tubing string. Screen 30 prevents the gravel from entering the production tubing.

The present invention allows a fluid slurry comprising gravel, gel, and water to be injected into annulus 27 and allows removal of undesired material such as gel from the gravel pack.

Figure 1B:
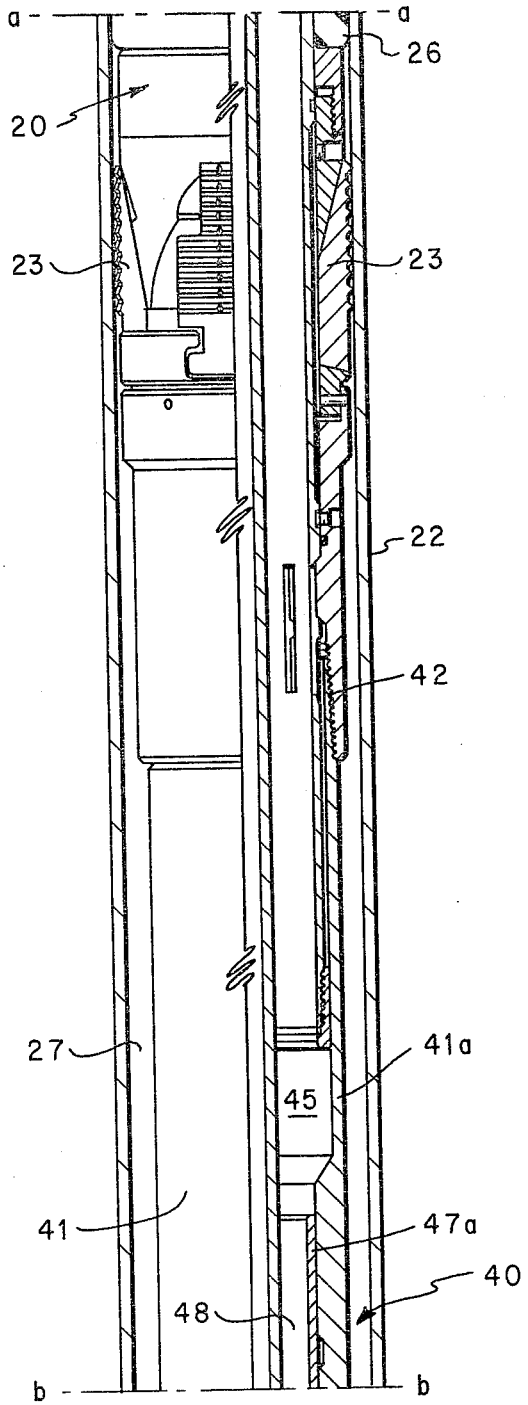
Figure 1C:
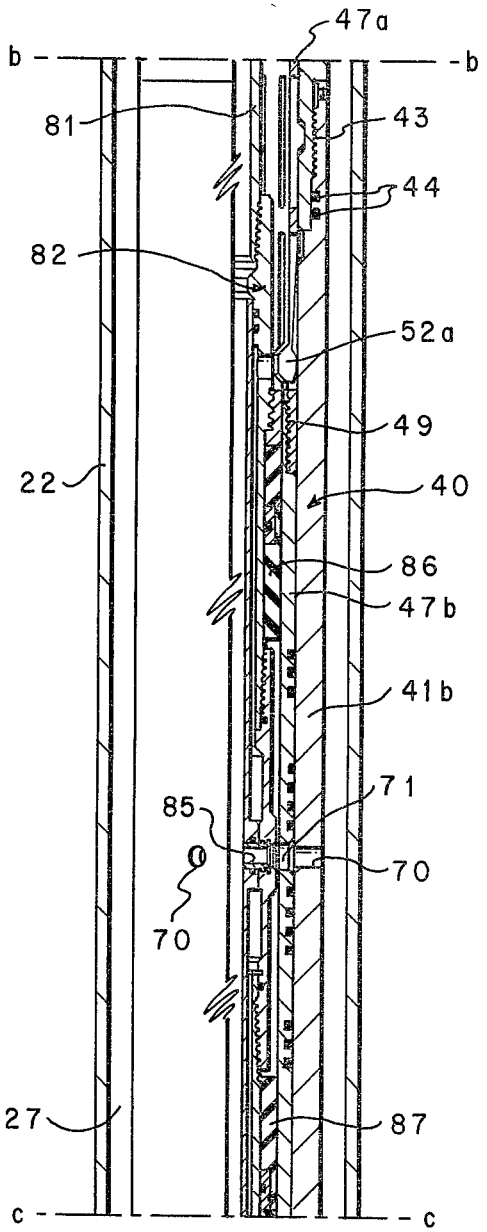
Figure 1D:
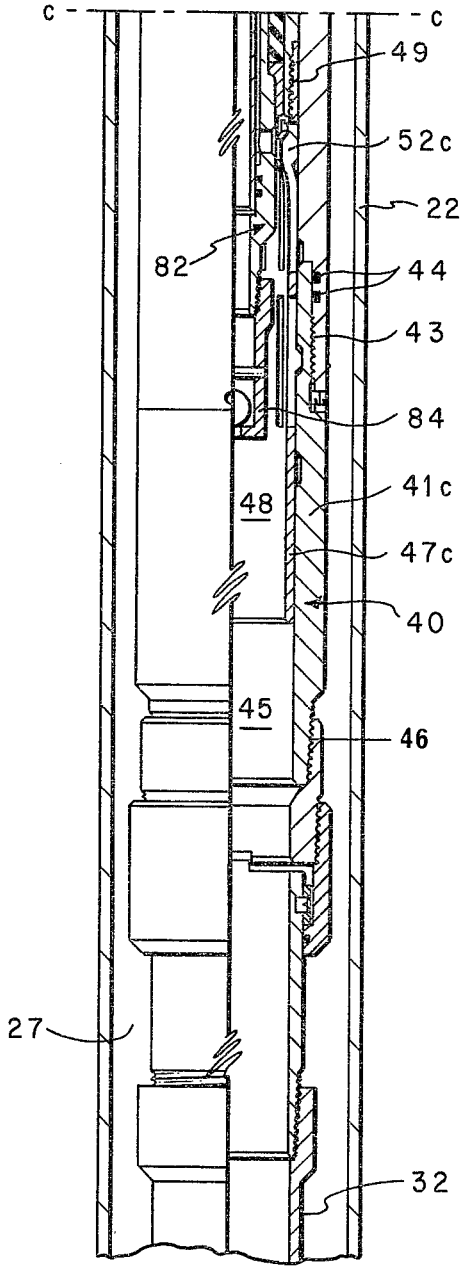

Preferrably, the well tool or sleeve valve 40 of the present invention is made up as part of production tubing string 32 extending below packer 20 and is located between packer 20 and the gravel pack screen. Well tool or sleeve valve 40 comprises a housing 41 engaged with the lower portion of packer 20 at threads 42. FIGS. 1B, 1C, and 1D show housing 41 consisting of three subassemblies 41*a*, 41*b* and 41*c* engaged by threads for ease of manufacture. Seals 44 provide a fluid tight connection between the subassemblies.

Housing 41 has a longitudinal bore 45 which extends therethrough. Bore 45 allows fluid communication longitudinally through well tool 40 with the production tubing above and below well tool 40. Threads 46, formed on the lower end of housing subassembly 41*c*, provide a means for connecting other well tools and production tubing to the lower end of housing 41.

Sleeve 47 is slidably disposed within bore 45 and has a longitudinal passageway 48 extending therethrough. Bore 45 and longitudinal passageway 48 are concentric with each other. When the well installation has been completed, formation fluids normally flow to the well surface through bore 45 and passageway 48.

Figure 2A:
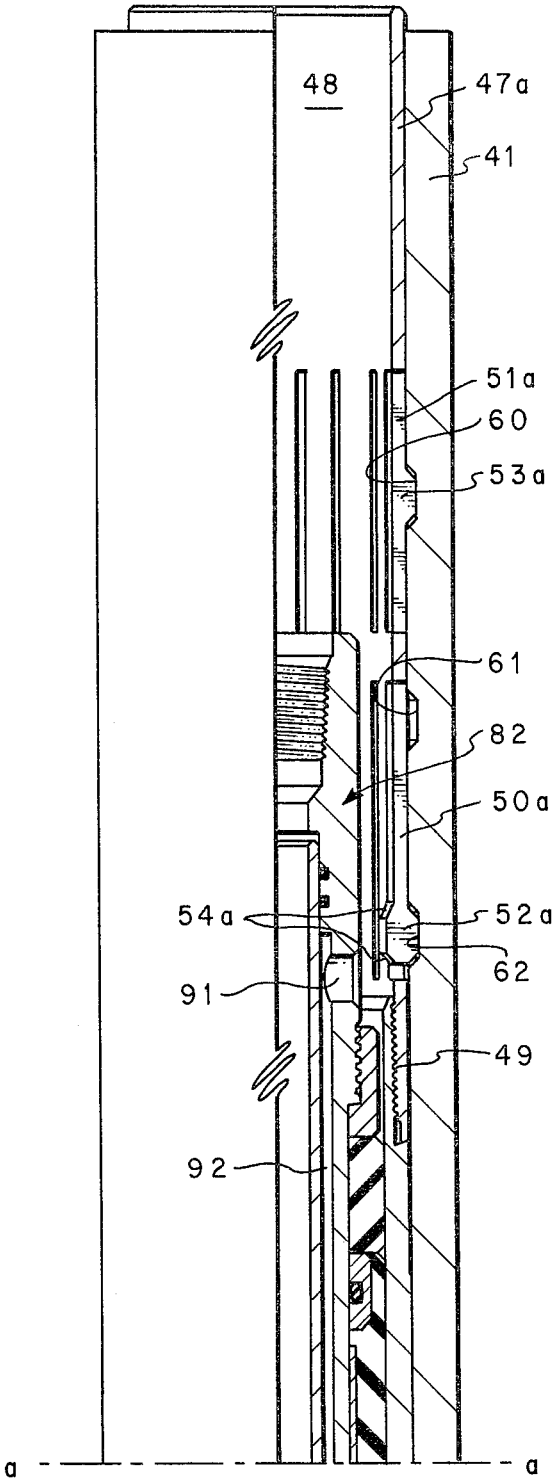
FIGS. 2A, 2B and 2C are drawings, partially in section and elevation, showing the well tool of the present invention with the sleeve valve in its third position blocking fluid communication with the exterior of the well tool.

For ease of manufacture, sleeve 47 comprises three, concentric tubular subassemblies 47*a*, 47*b* and 47*c* joined together by threads 49. Sleeve subassemblies 47*a* and 47*c* are identical. As shown in FIG. 2A, subassembly 47*a* has two collet portions 50*a* and 51*a*. Collet fingers 50*a* have a collet head 52*a* on one end. Collet fingers 50*a* can flex inwardly allowing collets heads 52*a* to form a restriction or reduced diameter portion within longitudinal passageway 48. Inner surface 54*a* on collet heads 52*a* forms a no go shoulder when collet heads 52*a* are projected inwardly. Detent collets 51*a* are spaced longitudinally from collet fingers 50*a*. Rib 53*a* projects radially from each detent collet 51*a*.

Figure 2B:
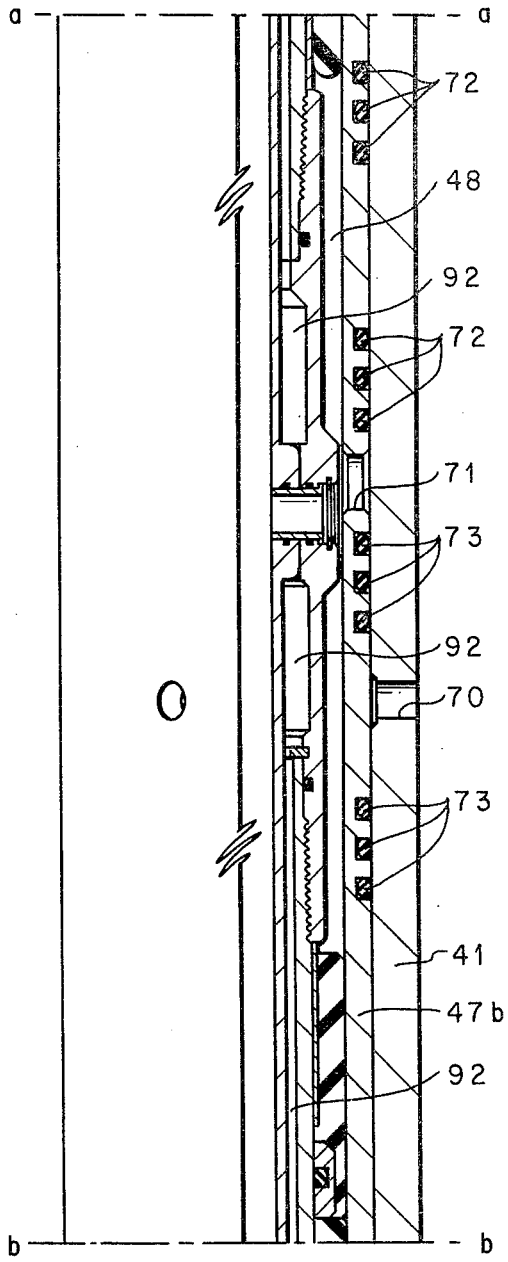
Figure 2C:
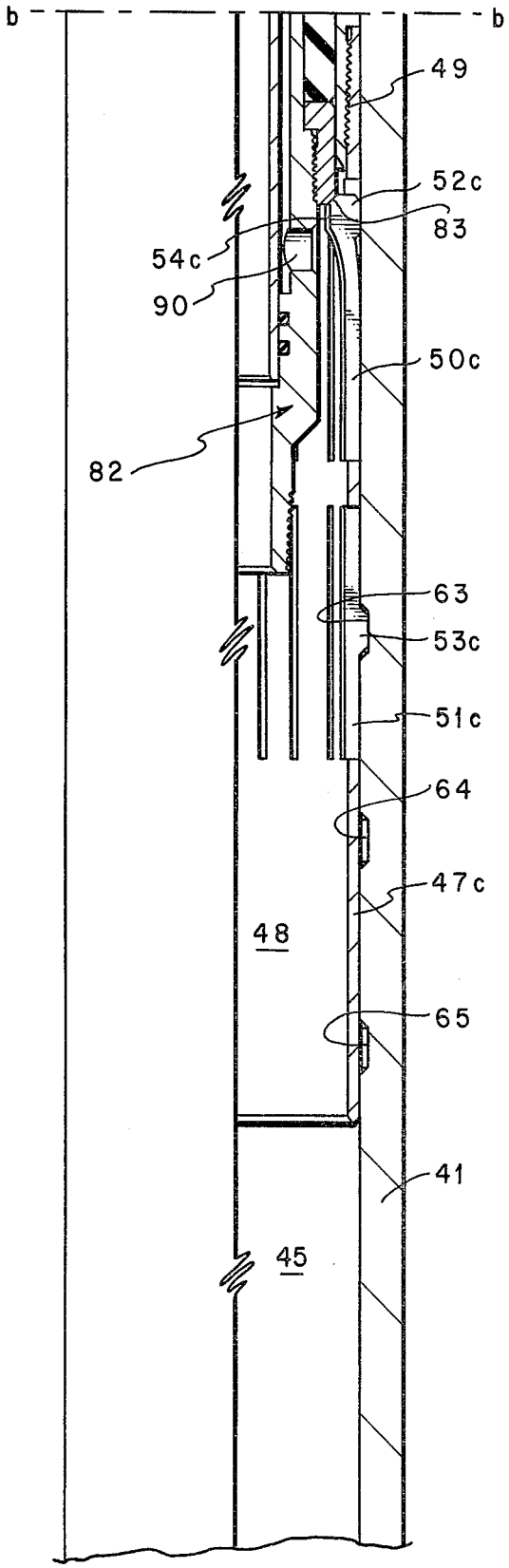

Recesses 60 through 65 are formed on the inside diameter of housing 41. Recesses 60, 61, and 62 are spaced longitudinally on one side of lateral port 70 as shown in FIG. 2B. Recesses 63, 64, and 65 as shown in FIG. 2C are spaced on the other side of lateral ports 70. Lateral ports 70 allows fluid to communicate btween bore 45 and the exterior of housing 41. Recesses 60 through 65 are sized to receive collet heads 52*a* and 52*c* and collet ribs 53*a* and 53*c*. As will be explained later, recesses 60 through 65 cooperate with the collets to define the three positions of sleeve valve 40.

The collets on sleeve subassembly 47*c* are identical with those on subassembly 47*a*. The parts have the same reference number followed by the letter c. For example, collet head 52*a* is the same as collet head 52*c*. Preferrably, the collets and recesses 60–65 are sized such that 10,000 pounds of force is required to shift sleeve 47 from one position to another relative to housing 41.

Sleeve subassembly 47*b* has a lateral passageways 71 extending through the wall of sleeve 47. O-rings 72 are carried on the exterior of sleeve 47, spaced longitudinally in one direction from lateral passageways 71. O-rings 73 are carried on the exterior of sleeve 47, spaced in the opposite direction from lateral passageways 71. O-rings 72 and 73 provide a means for sealing between the outside diameter of sleeve 47 and the inside diameter of housing 41.

Figure 3A:
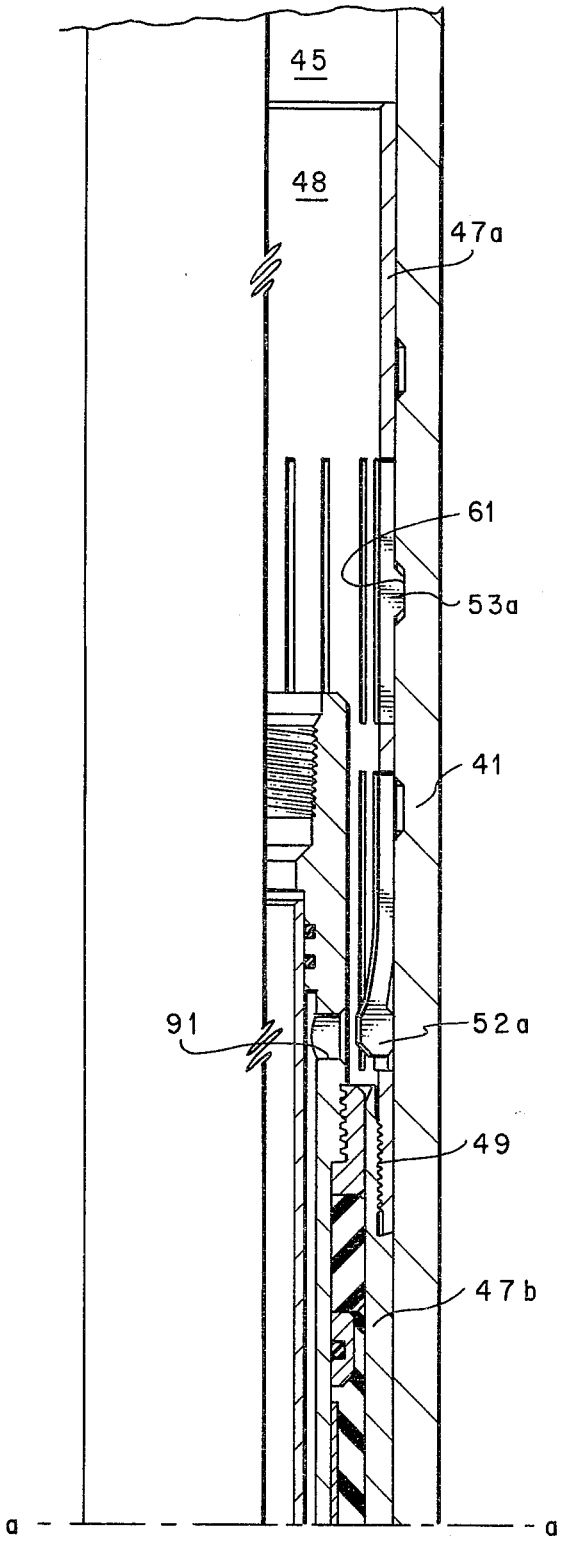
FIGS. 3A, 3B and 3C are drawings, partially in section and elevation, showing the well tool of the present invention with the sleeve valve in its first position.
Figure 3B:
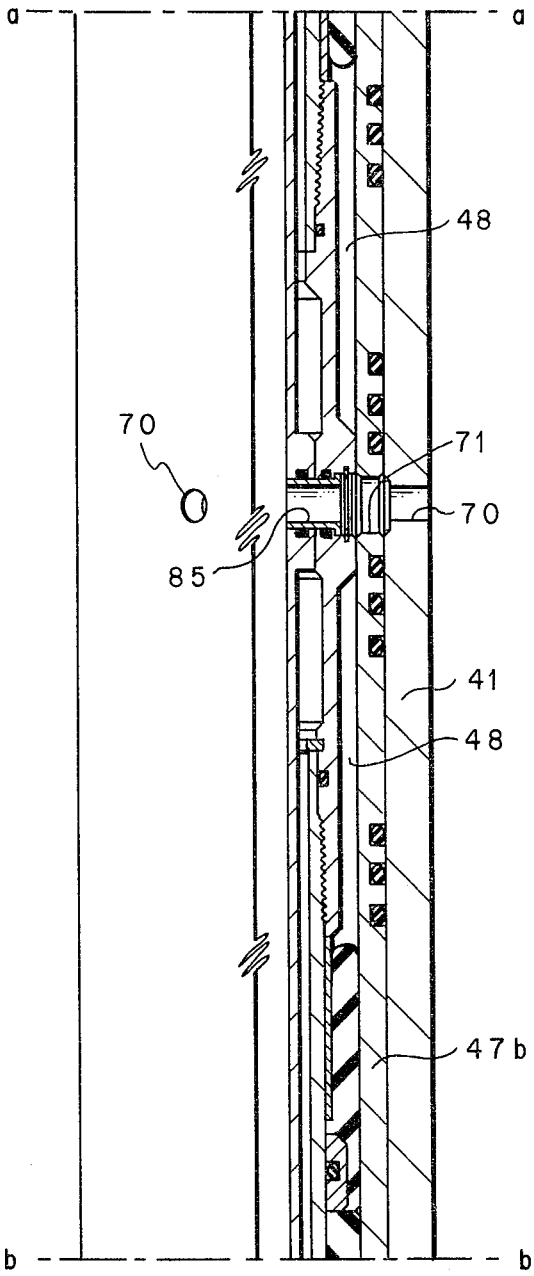
Figure 3C:
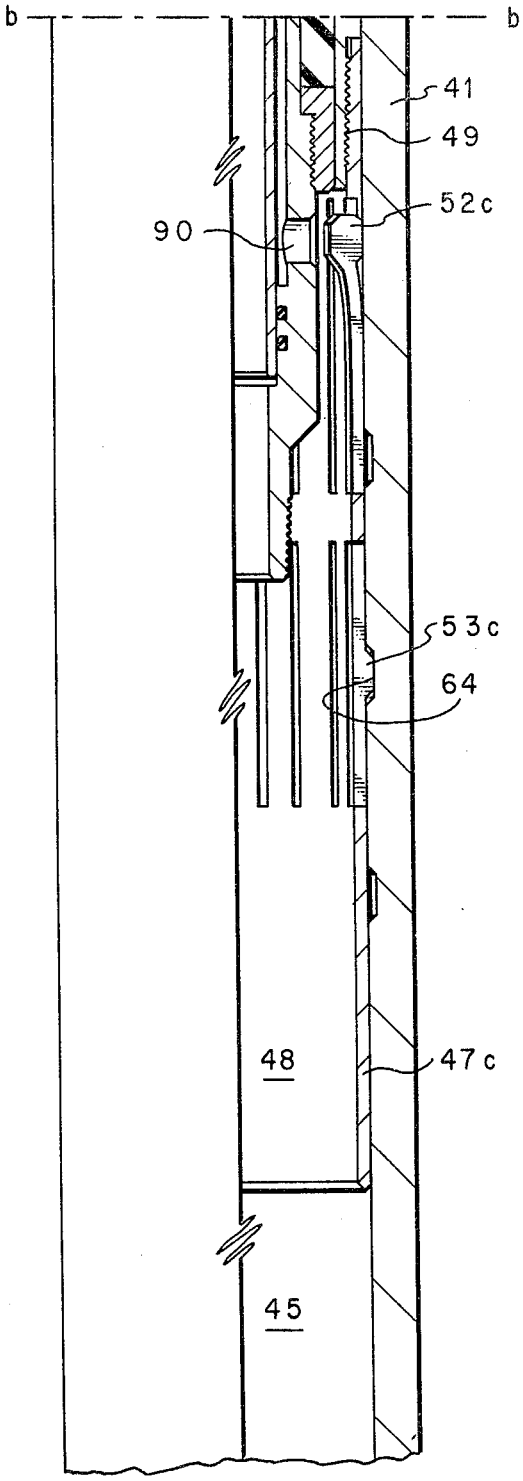

The first position of sleeve 47 with respect to housing 41 is shown in FIGS. 3A, 3B, and 3C. In the first position, lateral passageways 71 and lateral ports 70 are aligned such that fluid can communicate between longitudinal passageway 48 and the exterior of housing 41. Collet rib 53*a* is engaged with recess 61 and collet rib 53*c* is engaged with recess 64. Collet heads 52*a* and 52*c* are both flexed inwardly forming opposing no-go shoulders. As will be explained later, a shifting tool can be secured between the two no-go shoulders.

Figure 4A:
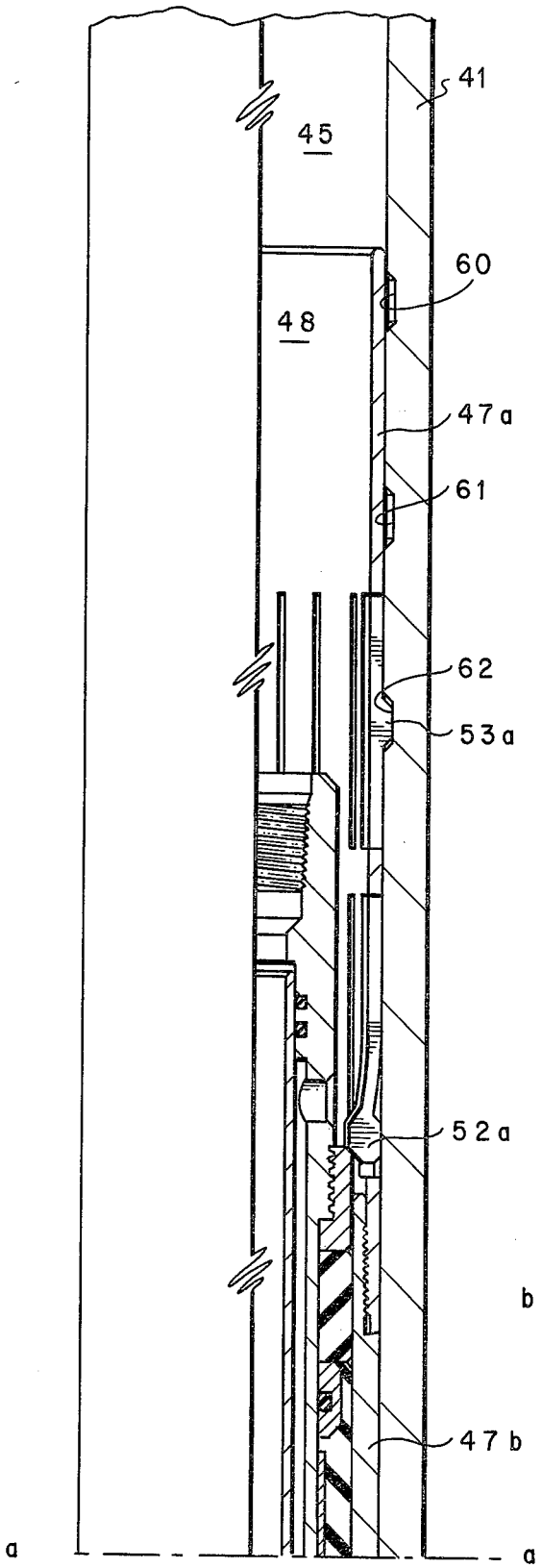
FIGS. 4A, 4B and 4C are drawings, partially in section and elevation, showing the well tool of the present invention with the sleeve valve in its second position.
Figure 4B:
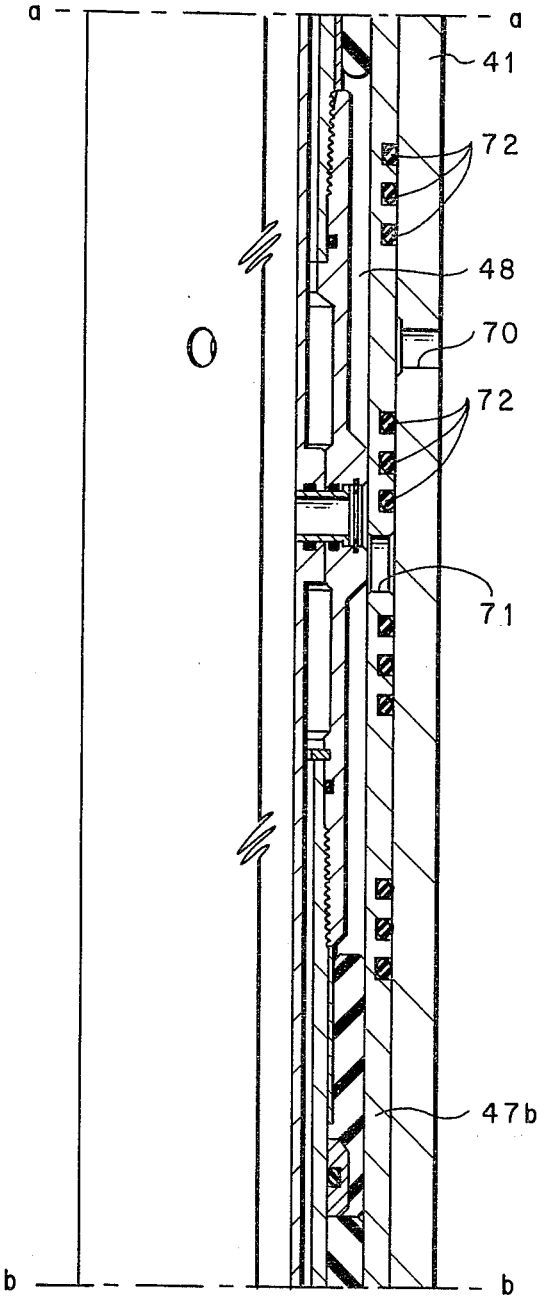
Figure 4C:
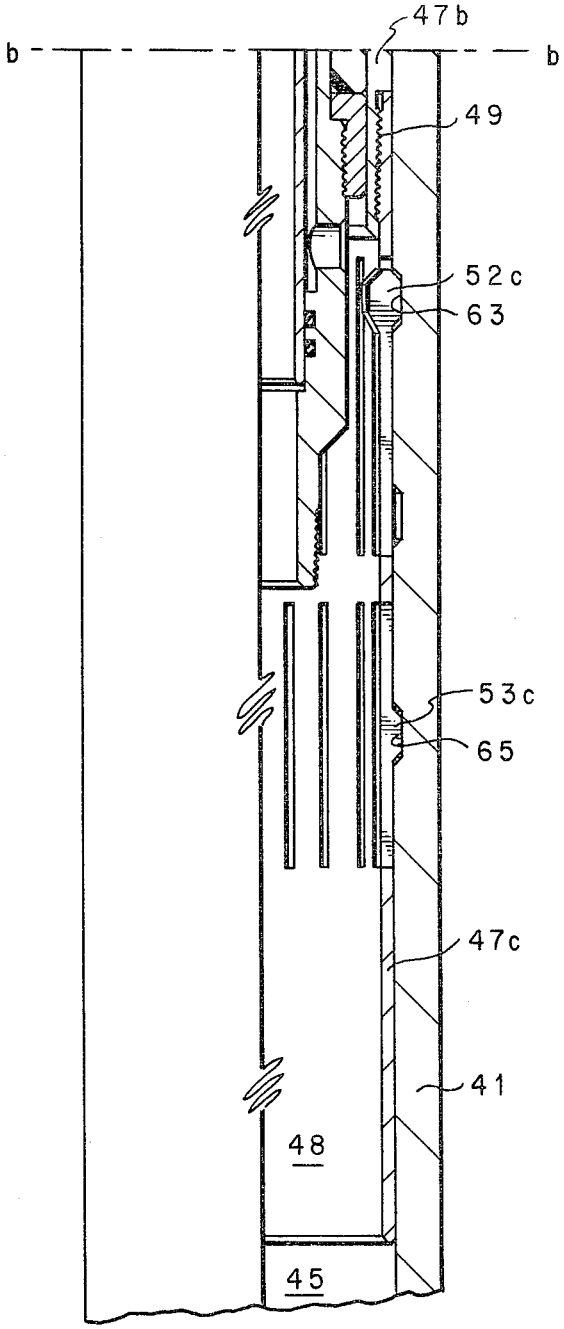

The second position of sleeve 47 with respect to housing 41 is shown in FIGS. 4A, 4B, and 4C. Lateral passageways 71 are no longer aligned with lateral ports 70. Seal means 72 are positioned straddling ports 70 and block fluid communication between longitudinal passgeway 48 and the exterior of housing 41. Collet rib 53*a* has moved to recess 62. Collet head 52*a* is still projecting into passageway 48 forming a no-go shoulder. Collet rib 53*c* has moved to recess 65. Collet head 52*c* has moved into recess 63 removing the lower restriction or no-go shoulder from longitudinal passageway 48. Therefore, a shifting tool could move in one direction through sleeve 47.

The third position of sleeve 47 with respect to housing 41 is shown in FIGS. 2A, 2B, and 2C. Sleeve valve 40 would normally be in its third position when initially installed and later while flowing the well. As shown in FIG. 2A, collet head 52*a* is positioned within recess 62. Therefore, longitudinal passageway 48 has an unrestricted inside diameter for receiving a shifting tool from the well surface. Collet head 52*c* is projecting inwardly forming a no-go shoulder preventing movement of a shifting tool through longitudinal passageway 48 without moving sleeve 47 sequentially to its first and second positions. In the third position of sleeve 47, seal means 73 straddle ports 70 preventing fluid communication therethrough. As previously noted, the collets on sleeve subassemblies 47*a* and 47*c* provide a means for released holding sleeve 47 in each position until approximately 10,000 pounds of force has been applied to sleeve 47.

OPERATING SEQUENCE

FIG. 5 shows the well tool or sliding sleeve valve 40 of the present invention made up as part of the production tubing string 32 extending below production packer 80. Packer 80 is a schematic representation of packer 20 shown in detail in FIGS. 1A–1D. Preferrably, sleeve valve 40 is initially installed between a packer and a gravel pack screen such as 30 with sleeve 47 in its third position. The production packer, sleeve valve, and gravel pack screen must have an inside diameter compatible with the outside diameter of the shifting tool used to position the sleeve valve. For purposes of illustration only, shifting tool 82 is shown with an enlarged outside diameter. In actual use, the outside diameter of shifting tool 82 must be compatible with the inside diameter of production tubing string 32.

Production packer 20 and the well tools extending there below are releasably secured within casing 22. A service tubing string or work string 81 with shifting tool 82 attached to the lower end thereof is inserted through bore 21 of casing 22, packer 20, bore 45 of housing 41 and longitudinal passageway 48 of sleeve 47 until the shifting tool engages a restricted inside diameter or no-go shoulder. With sleeve 47 in its third position, the shifting tool will pass through sleeve 47 until the shifting tool engages the lower set of collet heads 52*c* as shown in FIG. 1D.

The shifting tool 82, shown in detail in FIGS. 1C and 1D, is generally referred to as a selective injection packer (SIP). Various other shifting tools could be used with the present invention as long as it has an outside diameter compatible with collet heads 52*a* and 52*c* to shift sleeve 47 and flow passages for injecting fluid into lateral passageway 71 and gravel pack screen 30. The ability to inject fluid directly through screen 30 as shown in FIG. 5 is one of the major improvements offered by the present invention.

Shifting tool 82 is shown in FIGS. 2A, 2B, and 2C without work string 81 attached. As best shown in FIG. 2C, lower shoulder 83 on shifting tool 82 can engage collet heads 52*c* when sleeve 47 is in its third position. When a preselected amount of force is applied one direction by shifting tool 82 to sleeve 47, the upper and lower sets of collets on subassemblies 47*a* and 47*c* will flex inwardly allowing sleeve 47 to move to its first position aligning lateral passageway 71 with lateral ports 70 as shown in FIGS. 1C and 3B.

In its first position, collet heads 52*a* and 52*c* are flexed inwardly securing shifting tool 82 therebetween. A fluid slurry, preferrably gravel, gel and water, can be injected from the well surface through work string 81 to shifting tool 82. A ball check valve 84 is attached to the lower end of shifting tool 82 preventing fluid flow therefrom as shown in FIG. 1D. Shifting tool 82 is sized such that when engaged between collet heads 52*a* and 52*c*, ports 85 in the wall of shifting tool 82 is aligned with lateral passageways 71 and lateral ports 70. Seal means 86 and 87 are carried on the exterior of shifting tool 82 on opposite sides of ports 85. Seal means 86 and 87 direct the slurry flowing from ports 85 into passageways 71 and ports 70.

The gravel pack slurry can be pumped from the well surface through work string 81 to shifting tool 82. Ball check valve 84 prevents fluid flow out of the lower end of shifting tool 82. The slurry is deposited in annulus 27 around gravel pack screen 30 by flowing through aligned ports 85, lateral passageways 71 and lateral ports 70. Shifting tool 82 is particularly adapted for gravel pack use because ports 90 and 91 and annular flow passageway 92 allow fluid return to the well surface.

After a desired amount of slurry has been deposited within annulus 27, shifting tool 82 can be lowered to shift sleeve 47 to its second position blocking lateral ports 70. Collet heads 52*c* are engaged with recess 63 allowing shifting tool 82 to move through production tubing 32. Work string 81 can then lower shifting tool 82 to a desired location within screen 30.

As seen in FIG. 5, water can be injected down work string 81 through ports 85 of shifting tool 82 and into the gravel pack surrounding screen 30. Seal means 86 and 87 on the exterior of shifting tool 82 direct the water through screen 30 by forming a fluid tight seal with the inside diameter of screen 30. The portion of the gravel pack which is compressed by this method is defined by the spacing between seal means 86 and 87 and the water injection repeated. In this manner, the entire gravel pack could be compressed and undesired fluids removed.

By monitoring injection pressure and the rate of fluid returns at the well surface, discontinuities in the gravel pack could be detected. Work string 81 could be raised until shifting tool 82 moved sleeve 47 to its first position. Additional slurry could then be injected into annulus 27. The present invention allows repeating the stops of injecting slurry and flushing the gravel pack without having to remove work string 81 from the well bore. Thus, a tight, firm gravel pack can be deposited in annulus 27 with a minimum number of trips into the well.

The previous description is illustrative of only some of the advantages and uses of the present invention. Those skilled in the art will readily see other variations for a sleeve valve utilizing the present invention. Changes and modifications may be made with departing from the scope of the invention which is defined by the claims.

What is claimed is:

1. A well tool for controlling fluid communication from the interior of the tool to the exterior of the tool, comprising:

a. a housing having a longitudinal bore extending therethrough;

b. means for connecting each end of said housing to other well tools;

c. a sleeve slidably disposed within said longitudinal bore and having a longitudinal passageway extending therethrough;

d. a lateral port communicating fluid between said longitudinal bore and the exterior of said housing;

e. a lateral passageway extending through the wall of said sleeve;

f. means for sealing between the outside diameter of said sleeve and the inside diameter of said housing;

g. said sealing means spaced longitudinally on either side of said lateral passageway;

h. said sleeve having three positions with respect to said housing, the first position allowing fluid communication from the longitudinal passageway of said sleeve through said lateral passageway and said lateral port to the exterior of said housing, said sleeve slidable longitudinally in one direction with respect to said housing to its second position blocking communication through said lateral port and said sleeve slidable longitudinally in the other direction with respect to said housing to its third position blocking communication through said lateral port; and i. means, carried on said sleeve and the inside diameter of said housing, for releasably holding said sleeve in each position.

2. A well tool as defined in claim 1 wherein said releasable holding means further comprises:

a. a set of flexible collet fingers with collet heads carried near each end of said sleeve;

b. recesses formed within the inside diameter of said housing;

c. said collet heads being engageable with said recesses; and d. said recesses being spaced longitudinally with respect to said lateral port corresponding to said three positions of said sleeve.

3. A well tool as defined in claim 2 wherein at least one set of said collet fingers is flexed inwardly into the longitudinal passageway of said sleeve when said sleeve is in each of its three positions and the collet heads on said inwardly flexed collet fingers provide a shoulder for shifting said sleeve to another position.

4. A well tool as defined in claim 3 with said recesses and said collet fingers spaced longitudinally with respect to each other whereby insertion of a shifting tool into the longitudinal passageway of said sleeve to move said sleeve to said first position causes one set of collet fingers to flex inwardly into the bore of said sleeve preventing withdrawal of said shifting tool from the longitudinal passageway of said sleeve until said sleeve has been moved to either said second or said third position.

5. A well tool for controlling fluid communication from the interior of the tool to the exterior of the tool, comprising:

a. a housing having a longitudinal bore extending therethrough;

b. means for connecting each end of said housing to other well tools;

c. a sleeve slidably disposed within said longitudinal bore and having a longitudinal passageway extending therethrough, concentric with said longitudinal bore;

d. a lateral port communicating fluid between said longitudinal bore and the exterior of said housing;

e. a lateral passageway extending through the wall of said sleeve;

f. means for sealing between the outside diameter of said sleeve and the inside diameter of said housing;

g. said sealing means spaced longitudinally on either side of said lateral passageway;

h. said sleeve having three positions with respect to said housing, the first position allowing fluid communication from the longitudinal passageway of said sleeve through said lateral passageway and said lateral port to the exterior of said housing, said sleeve slidable longitudinally in one direction with respect to said housing to its second position blocking communication through said lateral port, and said sleeve slidable longitudinally in the other direction with respect to said housing to its third position blocking communication through said lateral port;

i. means for releasably holding said sleeve in each position; and j. a portion of said holding means projecting inwardly into the longitudinal passageway of said sleeve preventing movement of a shifting tool through said longitudinal passageway until said sleeve has moved from one position to another.

6. A well tool as defined in claim 5, wherein said releasable holding means further comprises:

a. a set of flexible collet fingers with collet heads carried near each end of said sleeve;

b. recesses formed within the inside diameter of said housing;

c. said collet heads being engageable with said recesses; and d. said recesses being spaced longitudinally with respect to said lateral port corresponding to the three positions of said sleeve.

7. A well tool as defined in claim 6, further comprising:

a. at least one of the sets of said collet heads projecting into the bore of said sleeve when said sleeve is in its first, second or third position; and b. said set of collet heads restricting passage through said longitudinal passageway until engaged by a shifting tool to move said sleeve from one position to another position.

8. A well tool as defined in claim 7, further comprising:

a. said recesses and said sealing means spaced longitudinally such that when said sleeve is in its third position, the lower set of collet heads projects into said longitudinal passageway and are engageable by said shifting tool to move said sleeve to said first position; and b. both sets of said collet heads project inwardly into said longitudinal passageway when said sleeve is in said first position whereby movement of said shifting tool longitudinally in either direction with respect to said housing will shift said sleeve to said second or third position.

9. An improved gravel pack tool of the type having a well packer and means for attaching a gravel pack screen below the well packer wherein the improvement, a sliding sleeve valve connected between the well packer and means for attaching a screen, comprises:

a. a housing having a longitudinal bore extending therethrough;

b. means for connecting each end of said housing to other well tools;

c. a sleeve slidably disposed within said longitudinal bore and having a longitudinal passageway extending therethrough;

d. a lateral port communicting fluid between said longitudinal bore and the exterior of said housing;

e. a lateral passageway extending through the wall of said sleeve;

f. means for sealing between the outside diameter of said sleeve and the inside diameter of said housing;

g. said sealing means spaced longitudinally on either said of said lateral passageway;

h. said sleeve having three positions with respect to said housing, the first position allowing fluid communication with the longitudinal passageway of said sleeve through said lateral passageway and said lateral port to the exterior of said housing, said sleeve slidable longitudinally in one direction with respect to said housing to its second position blocking communication through said lateral port and said sleeve slidable longutindally in the other direction with respect to said housing to its third position blocking communication through said lateral port; and i. means for releasably holding said sleeve in each position comprising a set of flexible collet fingers with collet heas carried near each end of said sleeve, recesses formed within the inside diameter of said housing, said collet heads being engageable with said recesses, and said recesses being spaced longitudinally with respect to said lateral port corresponding to the three positions of said sleeve.

10. A well tool as defined in claim 9, further comprising:

a. at least one of the sets of said collet heads projecting into the longitudinal passageway of said sleeve when said sleeve is in its first, second or third positions; and b. said set of collet heads restricting passage through said longitudinal passageway until engaged by a shifting tool to shift said sleeve from one position to another position.

11. A well tool as defined in claim 9, further comprising:

a. said recesses and said sealing means spaced longitudinally such that when said sleeve is in its third position, the lower set of collet heads projects into said longitudinal passageway and are engageable by said shifting tool to shift said sleeve to said first position; and b. both sets of said collet heads project inwardly into said longitudinal passageway when said sleeve is in said first position whereby movement of said shifting tool longitudinally in either direction with respect to said housing will shift said sleeve to said second or third position.

12. The method of installing a gravel pack within a well bore defined by a casing string, the gravel pack being deposited within an annulus formed between the casing and well tools forming the lower end of a production tubing string, the steps comprising:

a. installing within the casing a well packer with a sliding sleeve valve and gravel pack screen attached below said packer;

b. lowering a shifting tool through the bore of said packer to open said sliding sleeve valve and allow communication of fluid from the bore of the sleeve valve to the exterior thereof;

c. injecting a fluid slurry comprising gravel, gel, and water through said shifting tool and sleeve valve into the annulus between the casing and gravel pack screen;

d. lowering said shifting tool through said sliding sleeve valve to shift said sleeve valve to a position blocking fluid communication with the exterior of said sleeve valve;

e. positioning said shifting tool within said gravel pack screen to allow injection of liquid from said shifting tool through said screen to compress said slurry previously injected into said annulus.

13. The method of installing a gravel pack within a well bore as defined in claim 12, further comprising:

a. lowering said shifting tool to inject fluid through said gravel pack screen to remove gel and other undesired material from said slurry;

b. raising said shifting tool to open said sliding sleeve valve to inject more slurry into said annulus through said sliding sleeve valve; and c. repeating steps a. and b. until a tight, firm gravel pack has been deposited in said annulus.

* * * * *